United States Patent [19]

Booth et al.

[11] Patent Number: 4,763,857

[45] Date of Patent: Aug. 16, 1988

[54] GUIDANCE APPARATUS FOR PROJECTILES

[75] Inventors: Bryan Booth, Kidderminster; William H. Nicolson, Bewdley, both of England

[73] Assignee: Imi Kynoch Limited, Witton, England

[21] Appl. No.: 78,849

[22] Filed: Jul. 28, 1987

[30] Foreign Application Priority Data

Jul. 29, 1986 [GB] United Kingdom ..... 8618510

[51] Int. Cl.[4] ..... F42B 15/033

[52] U.S. Cl. ..... 244/3.22

[58] Field of Search ..... 244/3.22; 239/265.11, 239/265.19, 265.35

[56] References Cited

U.S. PATENT DOCUMENTS

| | | | |
|---|---|---|---|
| 4,463,921 | 8/1984 | Metz | 244/3.22 |
| 4,482,107 | 11/1984 | Metz | 244/3.22 |
| 4,589,594 | 5/1986 | Kranz | 244/3.22 |
| 4,646,991 | 3/1987 | Kranz | 244/3.22 |
| 4,681,283 | 7/1987 | Kranz | 244/3.22 |
| 4,691,876 | 9/1987 | Kranz | 244/3.22 |

FOREIGN PATENT DOCUMENTS

| | | |
|---|---|---|
| 0069440 | 1/1983 | European Pat. Off. . |
| 2846372 | 10/1978 | Fed. Rep. of Germany . |
| 3317583 | 5/1983 | Fed. Rep. of Germany . |
| 2501359 | 2/1982 | France . |
| 2066181 | 7/1981 | United Kingdom . |
| 2146299 | 4/1985 | United Kingdom . |

*Primary Examiner*—Charles T. Jordan

*Attorney, Agent, or Firm*—Cushman, Darby & Cushman

[57] ABSTRACT

The trajectory of a projectile is variable by means of a thrust generated by gas issuing from a nozzle, the nozzle normally rotating at high speed about the axis of the projectile but assuming a desired angular orientation for a predetermined period of time in order to impart a lateral thrust to the projectile thereby changing its trajectory.

9 Claims, 4 Drawing Sheets

GUIDANCE APPARATUS FOR PROJECTILES

FIELD OF THE INVENTION

This invention relates to guidance apparatus for projectiles, especially gun shells but also missiles having an on-board propulsion unit such as a solid propellant motor.

THE PRIOR ART

Normally, the trajectory of a given gun-shell is determined by the attitude of the gun upon firing and, once fired, it follows a ballistic trajectory. It is, however, advantageous if the trajectory can be varied as desired, as in the case of, for example, guided missiles, so as to improve accuracy particularly where the target is moving.

SUMMARY OF THE INVENTION

According to one aspect of the present invention there is provided guidance apparatus adapted to be mounted on a projectile for guiding the projectile during flight, the apparatus comprising:

(a) a source of pressurised gas;

(b) a nozzle rotatable about an axis and arranged to discharge gas produced, in use, from said source in a direction that is substantially perpendicular to said axis;

(c) first thrust vector control means adapted selectively to set up a disturbance, for example shock-waves, within the gas being discharged from the nozzle so as to produce a resultant thrust that causes the nozzle to rotate continuously in one direction about said axis and at an angular velocity sufficiently high that the normal ballistic trajectory of the projectile is substantially unaffected;

(d) second thrust vector control means adapted selectively to set up a disturbance, for example shock-waves, within the gas being discharged from the nozzle so as to produce a thrust that brakes said rotational motion of the nozzle until it adopts, for a predetermined period of time, a predetermined position whereupon the gas discharging therefrom exerts a thrust on the projectile thereby varying its trajectory as desired, and (e) control means responsive to control signals for controlling the operation of both said thrust vector control means and thus, inter alia, any desired variation of the trajectory of the projectile.

The position from which the gas discharges to vary the trajectory of the projectile may be substantially stationary.

According to another aspect of the present invention there is provided a projectile, for example a gun shell, including such guidance apparatus. Usually, the apparatus would be mounted on the projectile so that the axis of rotation of the nozzle coincides with the longitudinal axis of the projectile.

The trajectory of such a projectile may therefore be varied as desired by the transmission of appropriate signals to the control means of the apparatus during flight.

The projectile may be a spinning or a non-spinning projectile. Preferred examples of the features specified above are as follows:

(a) the source of pressurised gas is a solid propellant charge, for example of the cast double base type, and is provided with an igniter for initiating burning of the charge at an appropriate stage during flight of the projectile. For example, depending on the estimated flight duration, ignition may occur simultaneously with launch of the projectile or it may occur thereafter. In any event, the charge will of course have to be ignited prior to effecting any desired variation in the trajectory of the projectile. Alternative sources of gas include, for example, liquified or pressurised gases stored, for example, in a valved container;

(b) the nozzle is formed in an annular member coaxially mounted on bearings for rotation about a tubular member whose bore communicates with the pressurised gas source. The wall of the tubular member has one or more passageways extending therethrough which connect the bore of the tubular member with an annular recess formed in the inner wall of the annular member, the recess in turn communicating with the inlet of the nozzle. Thus, after ignition (in the case of a solid propellant), gas is continuously conveyed to the nozzle from the source via the bore in the tubular member, the one or more passageways and the annular recess in the annular member;

(c) the first and second thrust vector control means comprise respective first and second opposed ports formed in the side walls of the expansion section of the nozzle and substantially in the plane in which the nozzle rotates. The ports communicate, via respective valved passageways, with the source of pressurised gas or, if desired, a further source of gas, whereby jets of gas may be injected selectively into the nozzle.

Each injected jet of gas thereby sets up shock waves within the nozzle. In particular, for so long as gas is injected through only one of the ports, the resulting shock wave produced will produce a thrust component that causes the nozzle to rotate about the axis of the projectile. Subsequently, a thrust component of opposite direction may be established by injecting gas through the other port instead thereby tending to brake the rotational motion of the nozzle. An alternative, although less preferred, form of thrust vector control means comprises one or more so-called spoiler devices located immediately adjacent to the outlet of the nozzle. The operation of such spoiler devices is well-known in the rocket motor art and therefore will not be described in detail here;

(d) where the thrust vector control means comprise opposed gas-injection ports as described above, the control means preferably includes a pair of solenoid valves for opening/closing the passageways and selectively operable by electrical signals generated in accordance with a number of variables including, in particular, the rotational speed of the nozzle and the angular position of the nozzle at any given instant in time on the one hand and the desired angular orientation of the nozzle in a predetermined position, and the duration in such position, having regard to the desired variation of the trajectory of the projectile, on the other hand. The rotational speed of the nozzle may be determined, for example, by a tacho-generator and its angular position, in relation to a reference point, by a potentiometer. The desired predetermined angular position of the nozzle, and the duration in such position, may be determined by an electronic data processor into which are input data relating to the target position together with the data referred to above. Data relating to the position of the target may be generated automatically, and be transmitted to the control means, by a seeker device mounted on the projectile. Alternatively, such data may be transmitted to the control means by land-, sea- or air-based apparatus, as appropriate.

BRIEF DESCRIPTION OF THE DRAWINGS

Apparatus of the invention will now be described in more detail, by way of example only, with reference to the accompanying drawings in which.

AS SHOWN ON THE DRAWINGS

Figure 1:
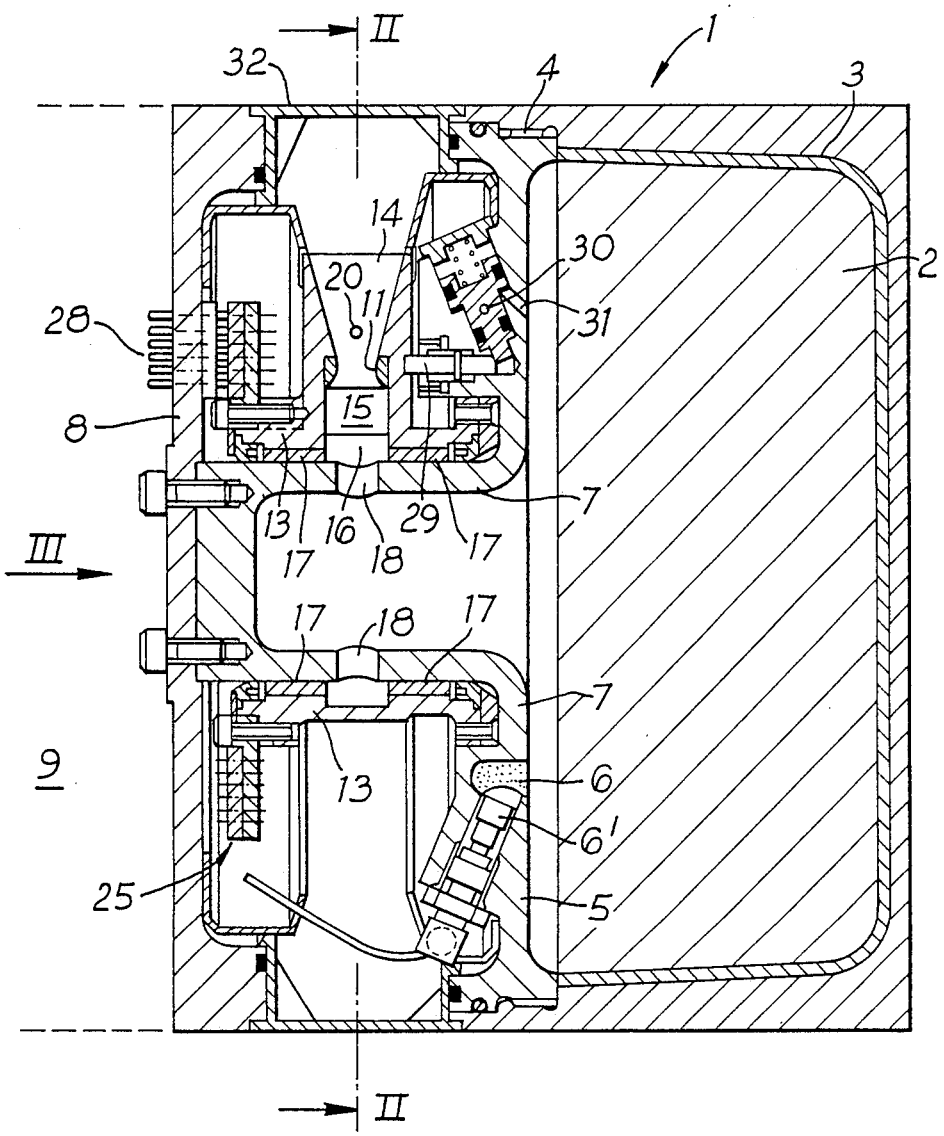
FIG. 1 is a sectional side elevation of the apparatus through an axis corresponding with the axis of the projectile.
Figure 2:
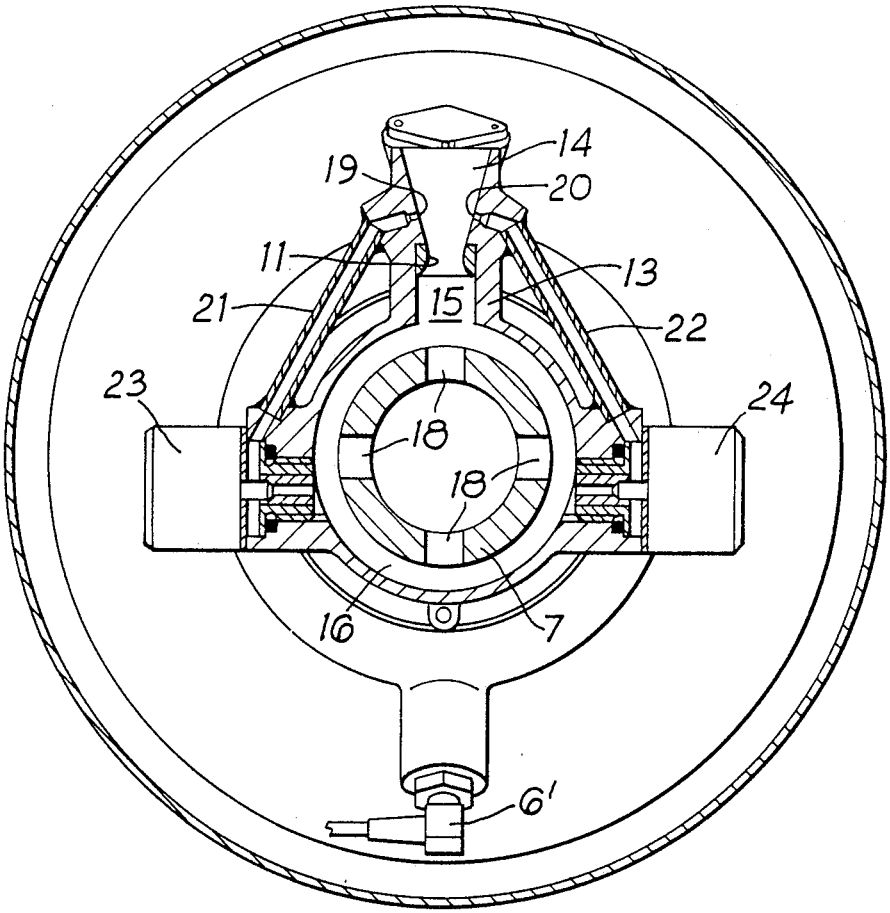
FIG. 2 is a sectional view on the line II—II of FIG. 1.

Referring to FIGS. 1 and 2 of the drawings, the apparatus designated generally by reference numeral 1 includes a cast double base propellant charge 2 housed in a chamber 3 which is sealingly joined to a nozzle assembly by a screw-threaded joint 4.

Figure 4:
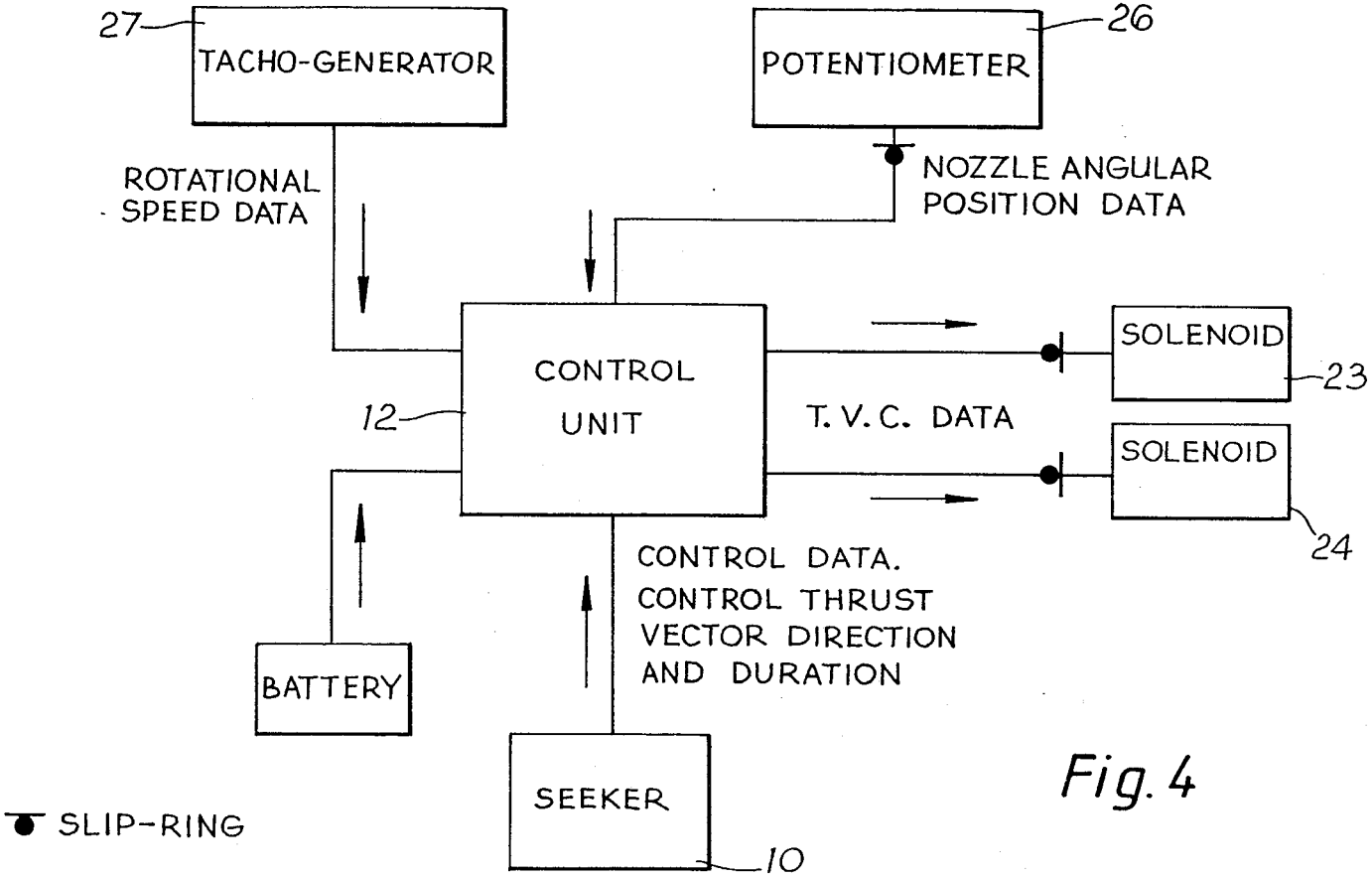
FIG. 4 is a block diagram of the control means of the apparatus of FIGS. 1 to 3.

The nozzle assembly comprises a base 5 which constitutes the forward closure for the chamber 3, the base 5 containing a part annular recess which houses a part-annular igniter 6 of pyrotechnic material for the propellant charge 2. The igniter 6 is initiated by an electrically fired primer 6'. Extending forward of the base 5, and integral therewith, is a thick-walled tubular member 7 attached at its front end to a bulkhead S which forms the rear end of the nose section 9 of the projectile. The nose section 9 houses, inter alia, a seeker unit 10 (FIG. 4) and its associated electronic equipment (not shown). The tubular member 7, during operation of the apparatus 1, ducts gas from the burning charge 2 to the nozzle assembly, as described in more detail below.

The nozzle assembly further comprises an annular member 13 which defines a frusto-conical nozzle 14 having a choke 11 and an inlet 15 which communicates with an annular recess 16 formed in the bore of the member 13. The member 13 is rotatably mounted on the tubular member 7 by two dry bearings 17. Four equispaced radial holes 18 connect the bore of the member 7 with the recess 16 and hence with the inlet 15 of the nozzle thereby providing a pathway for the flow of pressurised gas from the chamber 3 to the nozzle 14.

Referring specifically to FIG. 2, it can be seen that the nozzle 14 is provided with a pair of opposed ports 19, 20 that serve, as described below, to inject jets of gas into the nozzle 14. The ports 19, 20 are arranged in the plane that contains the longitudinal axis of the nozzle 14 and that is perpendicular to the longitudinal axis of the tubular member 7, i.e. in the plane of rotation of the nozzle 14 about the axis of the member 7.

The ports 19, 20 are connected to the annular recess 16, via respective small diameter pipes 21, 22 and respective on/off solenoid valves 23, 24 all of which are mounted on the member 13. When either of the valves 23, 24 is in its open position, a small proportion of gas generated by the propellant charge 2 is therefore injected through the port 19 or 20 into the main gas stream in the nozzle 14. The injected gas streams serve to establish shock waves within the nozzle, which in turn create rotational and braking thrust components, as the case may be, as is described below.

Figure 3:
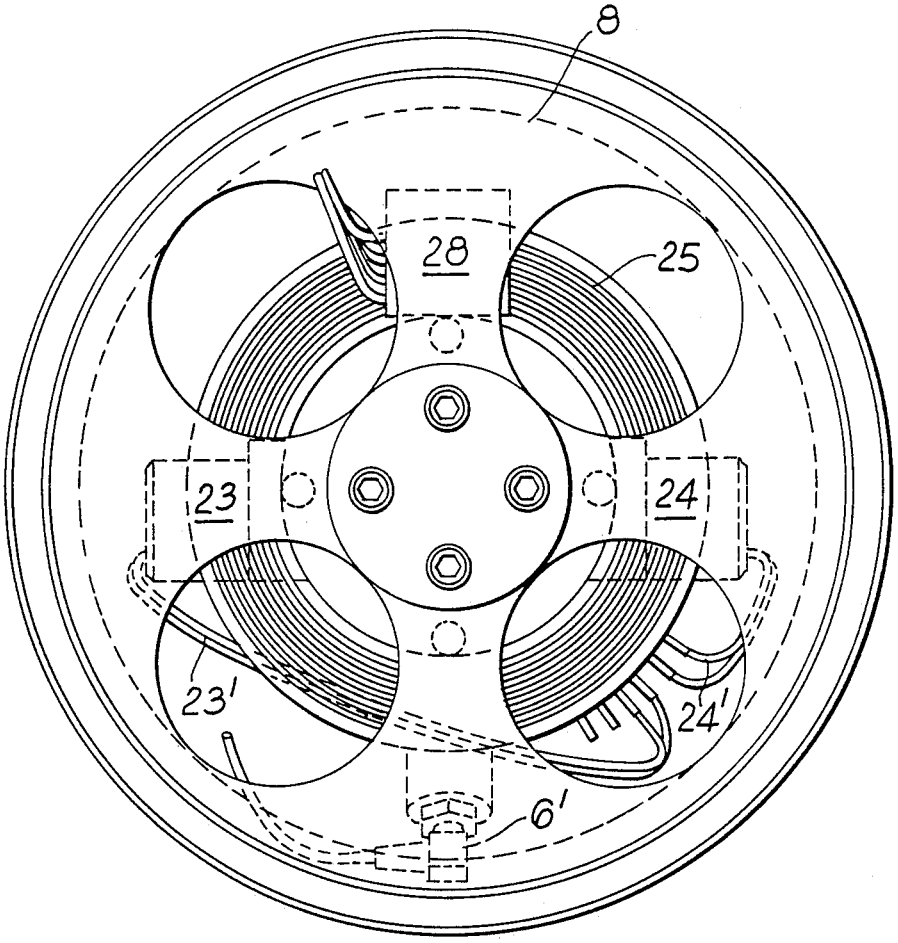
FIG. 3 is an end elevation in the direction of arrow III shown in FIG. 1.

The usual magnetic field-producing coils of the solenoid valves 23, 24 are electrically connected by leads 23', 24'(FIG. 3) to a slip-ring assembly 25 bolted to the member 13. The slip ring assembly 25 is additionally associated with a potentiometer 26 (FIG. 4) and a tachogenerator 27 (FIG. 4) to provide nozzle orientation data and nozzle rotational speed data respectively to a control unit 12 (FIG. 4) via a set of brushes 28 mounted on the bulkhead 8.

Referring specifically to FIG. 1, a disengageable detent 29 is provided to lock the member 13 against rotation during storage, transit, gun launch and (where desired) the initial flight period of the projectile. Irreversible release of the detent 29 is effected by a spring-loaded actuator 30 in response to build-up of gas pressure communicated to the actuator 30 through a small bore 31.

Also, in order to protect the apparatus 1 during storage, etc. from, in particular, moisture and foreign bodies, a protective plastic sleeve 32 is provided; on ignition of the charge 2, the hot gas issuing from the rotating nozzle 14 will quickly destroy the sleeve 32. Alternatively, the sleeve 32 could be removed prior to loading the projectile into the gun.

The apparatus 1 operates as follows: Upon launch of the projectile from the gun, or at a predetermined time thereafter, the propellant charge 2 is ignited by the igniter 6 in response to an electrical current fed from the control unit 12 to the primer 6'. Gas generated by the charge 2 therefore issues from the nozzle 14 via its inlet 15; also the detent 29 is released. At the same time, the solenoid valve 23 is de-energised, and therefore opened, by the control unit 12 via the slip ring assembly 25, whereas the solenoid valve 24 remains energised and therefore closed. A jet of gas is thereby injected into the nozzle 14 through the port 19 (FIG. 2). This sets up shock waves within the nozzle 14 which serve to produce a thrust component that causes the member 13 (and therefore the nozzle 14) and parts mounted on it to rotate rapidly in an anti-clockwise direction, as viewed in FIG. 2, about the axis of the projectile. Because of the rapid rotation of the nozzle 14, there will be an essentially zero net lateral thrust exerted on the projectile which will, therefore, travel in a ballistic trajectory.

Almost invariably, the trajectory of the projectile will require at least one correction during flight and such correction or corrections are instigated by a seeker unit 10 that is "locked" onto the target. Assume, therefore, that the seeker unit 10 senses that a trajectory correction is required. The seeker unit 10 transmits to the control unit 12 data signals reflecting the change that is required in terms of the radial thrust vector required (i.e. with the nozzle 14 substantially stationary) and its duration. Simultaneously, the control unit 12 is fed with information from the potentiometer 26 and the tachogenerator 27. The control unit 12 is thereby provided with data giving, at one and the same instant, the actual angular position and rotational speed of the nozzle 14 and also its required stationary orientation and duration in that orientation. The control unit 12 then de-energises the solenoid valve 23 and energises the solenoid valve 24. Accordingly, injection of gas through the port 19 ceases and injection of gas through the opposite port 20 commences, thereby creating a thrust component that rapidly brakes rotation of the nozzle 14 until it assumes the required, substantially stationary orientation as indicated by the potentiometer 26. The nozzle 14 maintains that orientation for the required period of time, during which both valves 23, 24 are arranged to be energised and thus closed, and the necessary change of trajectory is thereby imparted to the projectile. Then, by virtue of the solenoid valves 23, 24 reverting to their original respective modes, the nozzle 14 re-assumes its continuously rotating mode unless and until a further change in the trajectory, as signalled by the seeker unit 10, is required.

Partly because the nozzle is, in its normal rotating mode, moving at relatively high angular velocity, and partly because the response times of the control unit etc might be too slow, it is possible that, during the braking step, the nozzle 14 will "overshoot" the required angular orientation. This, however, may be readily dealt with by the control unit 12 during the braking step alternately reversing the modes of the solenoid valves 23, 24 thereby alternately reversing the direction of the thrust component until the nozzle 14 more or less comes to rest in the required orientation. A like operation may be effected to correct any drift from that orientation that might occur during the trajectory alteration.

In addition, it is desirable to limit the angular velocity of the nozzle during its normal, continuously rotating mode and this may be effected by the control unit 12 from time to time, in response to an excessive angular velocity as indicated by the tachogenerator 27, appropriately actuating the relevant valve to exert a temporary braking effect.

Whilst the specific apparatus described above is especially suited for mounting on a large diameter gun shell whose flight duration could be up to, for example, 80 seconds or more, apparatus of the invention could be used to guide missiles of the type having an on-board propulsion unit, for example a gas-generating solid propellant motor, in which case some of the gas generated by that propellant motor could be ducted to the guidance apparatus instead of there being a separate source such as the charge 2.

We claim as our invention:

1. Guidance apparatus adapted to be mounted on a projectile for guiding the projectile during flight, the apparatus comprising:

(a) source of pressurised gas;

(b) a nozzle rotatable about an axis and arranged to discharge gas produced, in use, from said source in a direction that is substantially perpendicular to said axis;

(c) first thrust vector control means adapted selectively to set up a disturbance, for example shock-waves, within the gas being discharged from the nozzle so as to produce a resultant thrust that causes the nozzle to rotate continuously in one direction about said axis and at an angular velocity sufficiently high that the normal ballistic trajectory of the projectile is substantially unaffected;

(d) second thrust vector control means adapted selectively to set up a disturbance, for example shock-waves, within the gas being discharged from the nozzle so as to produce a thrust that brakes said rotational motion of the nozzle until it adopts, for a predetermined period of time, a predetermined position whereupon the gas discharging therefrom exerts a thrust on the projectile thereby varying its trajectory as desired, and (e) control means responsive to control signals for controlling the operation of both said thrust vector control means and thus, inter alia, any desired variation of the trajectory of the projectile.

2. Apparatus as claimed in claim 1 mounted on a projectile.

3. Apparatus as claimed in claim 2 in which an axis of rotation of the nozzle coincides with the longitudinal axis of the projectile.

4. Apparatus as claimed in any one of claims 1 to 3 in which the source of pressurised gas is a solid propellant charge which is provided with an ignitor for initiating burning of the charge during the flight of the projectile.

5. Apparatus as claimed in of claim 1 in which the nozzle is formed in an annular member co-axially mounted on bearings for rotation about a tubular member having a bore communication with the pressurized gas source.

6. Apparatus as claimed in claim 5 in which the wall of the tubular member has one or more passageways extending therethrough which connect the bore of the tubular member with an annular recess formed in the inner wall of the annular member, the recess in turn communicating with the inlet of the nozzle.

7. Apparatus as claimed in claim 1 in which the first and second thrust vector control means comprise respective first and second opposed ports formed in the side walls of an expansion section of the nozzle and substantially in the plane in which the nozzle rotates, the ports communicating via respective valved passageways with a source of pressurised gas whereby jets of gas may be selectively injected into the nozzle to set up said disturbance.

8. Apparatus as claimed in claim 7 in which said passageways are valved by respective solenoid valves for opening and closing said passageways, said valves being selectively operable by electrical signals generated in accordance with a number of variables such as the rotational speed of the nozzle, the angular position of the nozzle and the desired angular orientation of the nozzle during a trajectory variation and the duration in such orientation having regard to the desired variation of the trajectory of the projectile.

9. Apparatus as claimed in claim 8 in which the rotational speed of the nozzle is determined by a tacho-generator and its angular position in relation to a reference point is determined by a potentiometer, the desired angular position being determined by an electronic data processor into which the input data relating to the target position is processed together with the other data set out hereabove.

* * * * *